United States Patent [19]

Ausnit

[11] Patent Number: 4,637,060

[45] Date of Patent: Jan. 13, 1987

[54] ZIPPER-LOCK BAG CHAIN ADAPTER FOR AUTOMATIC LOADING AND HEAT SEAL CLOSING

[75] Inventor: Steven Ausnit, New York, N.Y.

[73] Assignee: Minigrip, Orangeburg, N.Y.

[21] Appl. No.: 762,811

[22] Filed: Aug. 5, 1985

Related U.S. Application Data

[63] Continuation of Ser. No. 520,838, Aug. 5, 1983.

[51] Int. Cl.[4] ..... B65D 30/00

[52] U.S. Cl. ..... 383/37; 383/63; 206/820; 493/198; 493/215

[58] Field of Search ..... 206/554, 820; 383/37, 383/63, 65; 493/196, 201, 230, 238, 215, 198

[56] References Cited

U.S. PATENT DOCUMENTS

| | | | |
|---|---|---|---|
| 915,452 | 3/1909 | Litts | 383/37 |
| 2,664,239 | 12/1953 | Vogt | 383/37 |
| 3,030,003 | 4/1962 | Schanzle | 383/37 |
| 3,033,257 | 5/1962 | Weber | 383/37 |
| 3,199,671 | 8/1965 | Dajy | 206/256 |
| 3,358,821 | 12/1967 | Weisberg | 383/37 |
| 3,397,505 | 8/1968 | Critchell | 493/201 |
| 3,473,589 | 10/1969 | Gotz | 383/63 |
| 3,559,874 | 2/1971 | Tichenal | 383/37 |
| 3,618,286 | 11/1971 | Membrino | 383/37 |
| 3,619,395 | 11/1971 | Skendzic | 383/63 |
| 3,699,746 | 10/1972 | Tichenal et al. | 383/37 |
| 3,744,211 | 7/1973 | Titchenal et al. | 383/37 |
| 3,891,087 | 6/1975 | Maynard | 24/335 |
| 4,278,198 | 7/1981 | Norton et al. | 383/37 |
| 4,523,918 | 6/1985 | Ausnit | 493/198 |

*Primary Examiner*—William Price
*Assistant Examiner*—David T. Fidei
*Attorney, Agent, or Firm*—Hill, Van Santen, Steadman & Simpson

[57] ABSTRACT

A chain of reclosable plastic bags with the bags formed of a thin plastic material having front and rear walls with reclosable pressure interlocking rib and groove elements on the confronting faces at the lower end of the bag which will eventually form the bag top when the bag is disassociated from a chain with the bag walls being unattached along the upper end so that the bag is open and the bag may be filled by inserting contents between the edges with stiffening ribs on the surface of the bag material parallel to the unattached edges so that the bag wall and edge of the bag above the rib are prevented from collapsing with the bags interconnected to each other at the sides to form a chain.

15 Claims, 3 Drawing Figures

ZIPPER-LOCK BAG CHAIN ADAPTER FOR AUTOMATIC LOADING AND HEAT SEAL CLOSING

This is a continuation of application Ser. No. 520,838, filed Aug. 5, 1983.

BACKGROUND OF THE INVENTION

The invention relates to improvement in bags, and more particularly to a plastic bag chain wherein the series of bags are interconnected for handling, filling and sealing and the interconnection may be broken to separate bags from the chain.

In reclosable bags of the type referred to, pressure interlocking reopenable and reclosable rib and groove or zipper elements are formed along the top on confronting faces adjacent the bag top. A completed plastic bag of this type has flanges above the rib and groove elements to open the bag when it is used. However, these flanges in their original form were joined and later slit apart during the manufacturing process. The front and back walls are joined to each other along side seams, and the bottom edge is normally continuous to close the bag, or the bottom edges may be joined to form the seam. Reclosable plastic bags of this nature are disclosed, for example, in U.S. Pat. Nos. 3,198,228, 3,291,177, 3,338,284 and 3,340,116.

Bags of this type have been formed in chains, and in a machine adapted to receive such a chain, the rib and groove elements are separated for filling the bags, and then rejoined, after which the individual bags are torn from the chain for use. However, if any particle of material being filled or foreign element inadvertently gets between the rib and groove element, it will prevent satisfactory closure. Further, to make the bag tamper-proof evident requires an additional sealing and perforation operation that adds cost to the machine as well as complexity.

To overcome this problem, the bag chain can be run upside down, with the profiles at the bottom and with their respective flanges left united, while the bottom of the bag is slit and run at the top. However, such an arrangement cannot run through a chain bag type filling machine, since the film has to be properly guided and supported or it will collapse. Therefore, it is necessary to provide, near the upturned bottom edge of the bag chain, one or more guiding ridges. These ridges allow the bag chain to be handled in the same way as a regular bag chain where the profiles are used as a support and guide means.

It is accordingly an object of the present invention to provide an improved bag chain structure wherein reclosable bags are used, and the rib and groove elements are maintained locked throughout the filling and handling operation so as to avoid the possibility of improper rejoining of the rib and groove element, and to provide above the elements a tamper-proof evident means.

A still further object of the invention is to provide an improved bag structure wherein the bags may be filled through the bottom and wherein the bags can be handled by automatic machinery with accurate alignment of the bottom edges of the bag and the bags do not collapse or wrinkle or fold during their handling and during their being drawn through the machine.

A still further object of the invention is to provide an improved bag chain wherein the adjacent bags are joined by frangible links which are associated with the bag structure in such a manner that the bags, even when formed of very flexible thin, lightweight material, will retain their position in an automatic filling machine and can be handled in a relatively high speed filling and closing operation.

A feature of the invention is to provide a chain of bags which are inverted wherein the rib and groove elements are suspended downwardly and the bag is carried through a machine with the bottom edges of the bag faced upwardly and separated. Strengthening and supporting ribs are carried on the surface of the bag adjacent the bottom edges which reinforce the bag, hold the bottom edges straight and tend to prevent the bag from folding or wrinkling. For utilizing the maximum effect of the ribs, the bag is supported by the ribs on upwardly facing machine shoulders which engage beneath the ribs. Frangible interconnecting links are formed between the bags, and in one preferred form, the link is in alignment with the rib being formed of plastic from the rib by applying a heating element in the area of the rib to reduce the thickness of the plastic and reduce the width of the frangible link to a desired width which will break with a predetermined pull. In another form, plural links are used with one link being formed in alignment with the rib and another link being formed in alignment with the rib and groove elements.

Other objects, advantages and features will become more apparent with the teaching of the principles of the invention in connection with the disclosure of the preferred embodiments thereof in the specification, claims and drawings, in which:

DESCRIPTION

Figure 1:
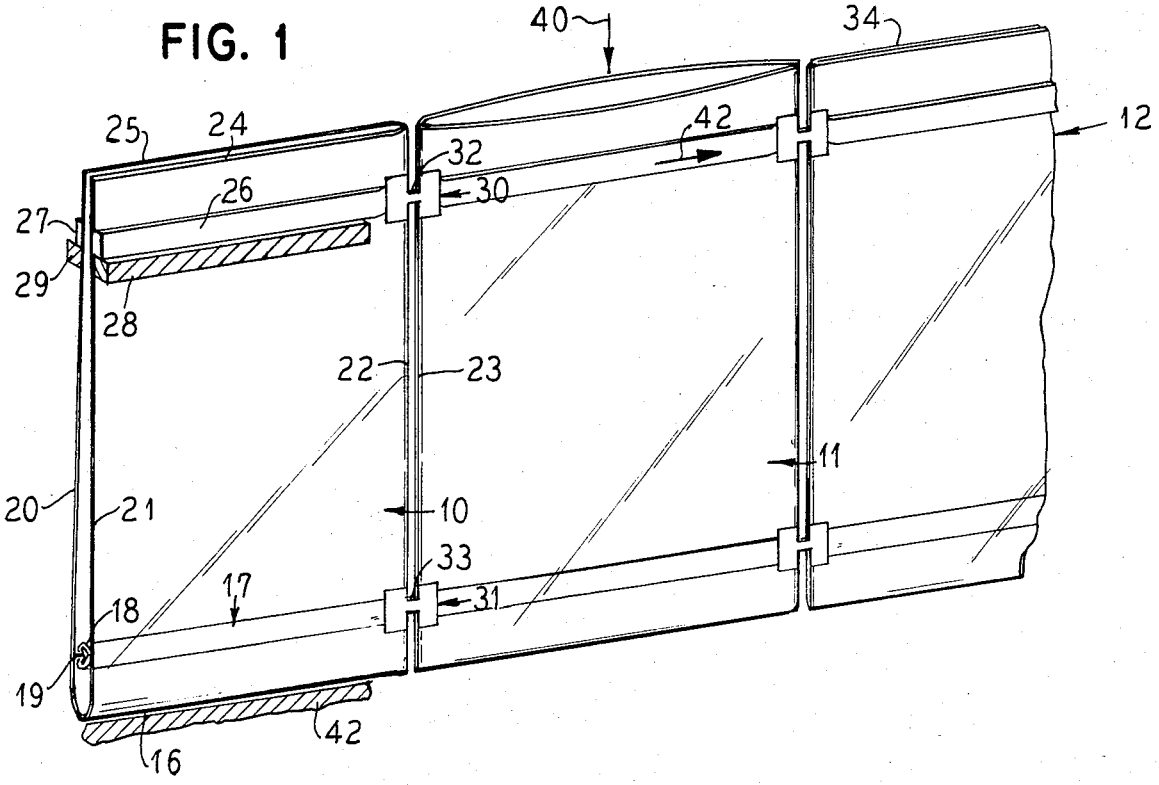
FIG. 1 is a perspective view partially in section illustrating a chain of interconnected bags constructed in accordance with the principles of the invention.
Figure 2:
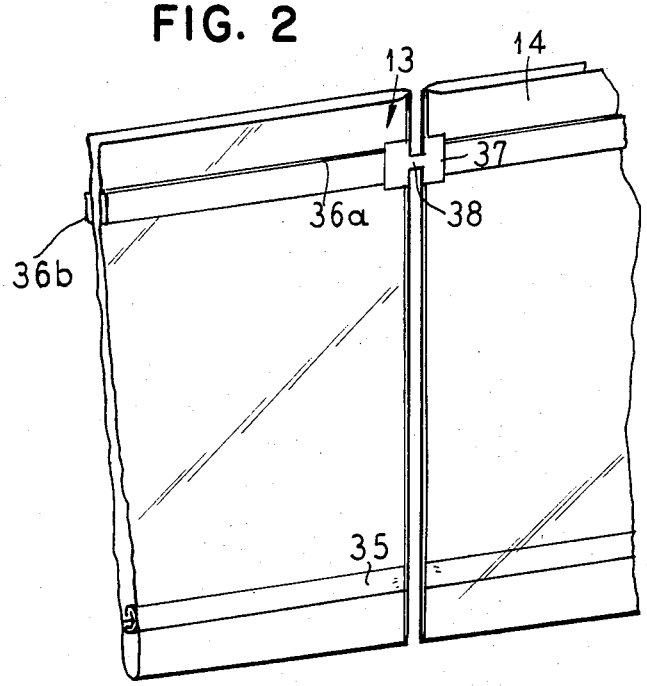
FIG. 2 is a fragmentary perspective view illustrating another form of link between individual bags of a chain.

In FIG. 1 a chain of interconnected bags are illustrated with the bags being shown at 10, 11 and 12. In FIG. 2, interconnected bags are shown at 13 and 14, and in FIG. 3, a separate bag is shown in sectional view at 15.

As illustrated in FIG. 1, the bags are in an inverted position with the top facing downwardly, and the top edge 16 being integral and doubled. The bag has confronting walls 20 and 21 formed of a thin plastic material such as polyethylene, and on the confronting faces of the walls adjacent the eventual bag top are pressure interlocking rib and groove elements 18 and 19 in the area which will be referred to as the profile strip 17.

The front and back walls of the bag are joined along their edges by heat seal seams 22 and 23. In handling the chain of bags, they are transported in their inverted position for filling, and for this purpose, the bottom edges 24 and 25 are kept unsealed for the insertion of contents, such as by a filling spout shown schematically by the arrowed line 40 being inserted between the separated edges 24 and 25.

Adjacent the separated bottom edges 24 and 25 are continuous laterally extending ribs 26 and 27. Preferably, a rib is located on each surface of the bag material and preferably on the outer surface. These ribs can be formed at the time the original bag chain is made by being extruded through an extruder head die which has a shape to form the ribs. In some instances, the ribs may be separate and attached later, but for rapid manufacture, the ribs are formed integrally with the material of the bag walls 20 and 21.

These ribs lend support and stiffening to the unsupported separated edges 24 and 25. With very thin bag material, the walls will sag at the upper edge. With fast handling, the edges will tend to wrinkle, and the supporting reinforcing ribs 26 and 27 prevent such wrinkling and lend vertical support to the bag material.

When the bags have been filled through the bottom opening, they are moved forwardly and the separated edges 24 and 25 are joined by a bottom seam 34.

Figure 3:
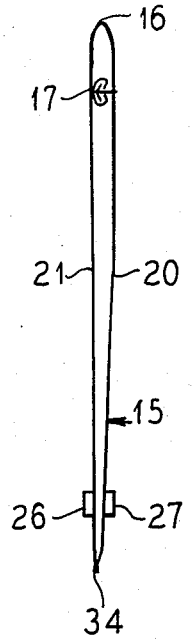
FIG. 3 is a vertical sectional view taken through a bag after it has been removed from the chain and showing the bag inverted to upright position.

In the finished bag, as illustrated in FIG. 3, the ribs 26 and 27 continue to function to provide reinforcement and support to the bag, being located at the bottom where the greatest amount of stress will occur due to the contents. The ribs 26 and 27 will coact with the bottom seam 34 to form a stronger bag.

For forming the bag chain and for rapidly and expeditiously handling the bags to pull the chain forward for mechanical filling and sealing, the bags are interconnected at one or more locations. Interconnecting link areas are shown in FIG. 1 at 30 and 31. These link areas have a narrowed frangible link portion 32 and 33 between the bags which is of a width and thickness so as to give a predetermined resistance to tearing when the bags are pulled forwardly. However, when the bag chain is held back and the foremost bag is to be removed, the link portion 32 and 33 will break so that the completed bag is separated or disassociated from the chain.

The links between the bags are conveniently and usefully formed by a heat seal or other type of spot seal applied between the bags at the location of the ribs 26 and 27. The plastic of the ribs will melt to form the link 30 which is in alignment with the ribs, and which is then reduced to form the narrowed area 32. Thus, as the bags are pulled forward, the transporting force is transmitted from bag to bag through the link and along the ribs and the component of force parallel to the rib tends to further stiffen and hold erect the side wall materials of the bag.

In the arrangement of FIG. 1, plural links are provided with the second link 33 being similarly formed by a heat application at the location of the profile strip 17. The narrowed area link 33 is then formed of a predetermined thickness and width so that it will break when a lead bag is torn from the strip and the strip is held in position.

In some forms, it may be desirable to attach the bags with only a single link area 37 in the manner illustrated in FIG. 2. As shown there, a single link area 37 has a frangible link portion 38 joining the adjacent bags 13 and 14. The link is in alignment with the ribs **36*a* and 36*b***.

As illustrated in FIG. 1, when the bags are being handled and filled, they are conveniently supported by shoulder members 28 and 29 on the machine. These shoulder members engage beneath the ribs 26 and 27 holding the ribs straight and supporting the side walls of the bag. When a longitudinal pull is being exerted on the bag chain, the walls of the bag are held erect by the pulling forces, but when the pulling ceases, the supports 28 and 29 will support the bag. One of the supports 28 or 29 will be absent in a limited area adjacent the filling station of the machine, so that the bag can be separated and it can then be filled with the contents in the manner previously described relative to the filling mechanism 40 of FIG. 1. Additional support may be provided by a sliding platform or surface 42 beneath the bag chain. Suitable mechanical means may be provided for drawing the bag chain forwardly and for restraining movement of the bag chain when the lead bag is to be torn off of the chain.

A completed bag is shown in section in FIG. 3 and will have the ribs 26 and 27 adjacent the bottom seam 34, and the rib and groove elements of the strip 17 will be interlocked and will not have been separated throughout the filling operation. Therefore, the facing areas between the rib and groove elements will not have been contaminated by any material and the manufacturer can be assured that the bag will reach the market with the rib and groove elements interengaed, because the flanges above the elements will be in joined condition. The user will sever or tear off along lines of weakened resistance the bag edge 16 at the top of the bag, thereby leaving two flanges above the fastener strip for pulling the strips apart for access to the bag contents. Thus, it will be seen that I have provided an improved plastic bag structure and structure for interconnecting bags into a chain which meet the objectives and advantages above set forth. The rib construction may be formed of the same material as the bag, but where a tough thin bag wall is employed, a plastic having a greater stiffness modulus may be used for the ribs, and the ribs, whether of the same or different material are preferably formed integrally during extrusion of the bag material, but may be attached by heat sealing or cementing to the bag wall subsequent to the tubular or film material of the bag being formed.

The advancing force for pulling the bag chain forwardly for filling and sealing may be applied at any suitable location, but preferably is applied at the location of the rib as indicated schematically by the arrowed line 42. Thus, the forces for pulling the bag forwardly are all centered and directed in alignment with the rib which has sufficient strength to be nonextensible and which aids in holding the bag walls erect and the edges 24 and 25 in alignment.

I claim as my invention:

1. A chain of reclosable plastic bags comprising in combination:

a series of bags of extruded plastic material having front and rear walls and upper and lower ends, with reclosable pressure interlocking rib and groove elements on confronting faces at said lower end which will form the bag top when the bag is disassociated from the chain;

seams forming side edges of the bags with the bag walls being unattached along said upper end so that each bag may be filled by inserting contents between said edges;

a stiffening rib extruded integrally with said plastic material and projecting outwardly on each of said walls and extending in parallel relation adjacent to said unattached edges;

each of said ribs being of such a size and shape that they will cooperate to act as guides and supporting means during a bag filling operation;

said ribs being aligned along the bag chain but being discontinuous from one another at said seams;

each of said ribs providing a downwardly facing shoulder along its lower side for supporting and guiding the associated bag along upwardly facing shoulder means associated with means for filling the bags;

and interconnecting means in the form of a frangible link separably interconnecting adjacent bags at the location of said side seams and being aligned with the ribs, said link transmitting forces so that the tension on the rib is transmitted between adjacent bags.

2. A chain of bags according to claim 1, wherein said interconnecting means comprise heat seals aligned with said ribs.

3. A chain of bags according to claim 2, wherein each of said heat seals has a narrowed frangible connecting link area of a width and thickness to give a predetermined resistance to tearing when the bags are pulled in the direction of the length of said ribs.

4. A chain of reclosable plastic bags constructed in accordance with claim 1, wherein said supporting stiffening ribs are formed from said plastic material substantially thicker than said walls.

5. A chain of reclosable plastic bags constructed in accordance with claim 1:

wherein the material of the bag beneath the rib and groove elements is integrally continuous to form a closure over the rib and groove elements for the bag.

6. A chain of reclosable plastic bags constructed in accordance with claim 1:

wherein said interconnecting means is aligned with said ribs and the ribs of adjacent bags in alignment with each other.

7. A chain of reclosable plastic bags constructed in accordance with claim 6:

wherein said interconnecting means is of a frangible spot seal construction and will accommodate separation of the bags with a predetermined force.

8. A chain of reclosable plastic bags constructed in accordance with claim 1:

wherein a plurality of interconnecting elements are included between the side seams of adjacent bags each being frangible with a predetermined pull of a bag required to disassociate it from an adjacent bag.

9. A chain of reclosable plastic bags constructed in accordance with claim 5:

wherein said interconnecting means is formed by the application of heat to the plastic ribs between adjacent bags.

10. A chain of reclosable plastic bags constructed in accordance with claim 1:

wherein said interconnecting means is a single frangible interconnecting link between adjacent bags.

11. A chain of reclosable plastic bags constructed in accordance with claim 10:

wherein said interconnecting link is frangible to permit disassociation of adjacent bags with a required predetermined separation force.

12. A chain of reclosable plastic bags constructed in accordance with claim 1:

wherein said interconnecting means is a plurality of interconnecting elements between adjacent bags.

13. A chain of reclosable plastic bags constructed in accordance with claim 4:

wherein the ribs are formed of a plastic material having a different stiffness modulus than the plastic material of the walls of the bag.

14. A chain of reclosable plastic bags comprising in combination:

a series of bags of plastic material having front and rear walls and upper and lower ends, with reclosable pressure interlocking rib and groove elements on confronting faces at said lower end which will form the bag top when the bag is disassociated from the chain;

seams forming side edges of the bags with the bag walls being unattached along said upper end so that each bag may be filled by inserting contents between said edges;

a stiffening rib projecting outwardly on each of said walls and extending in parallel relation to said unattached edges;

each of said ribs being of such a size and shape that they will cooperate to act as guides and supporting means during a bag filling operation;

said ribs being aligned along the bag chain but being discontinuous from one another at said seams;

each of said ribs providing a downwardly facing shoulder along its lower side for supporting and guiding the associated bag along upwardly facing shoulder means associated with means for filling the bags;

and spot seals interconnecting the side seams of adjacent bags and aligned with said ribs, said spot seals formed by a heat seal sealing said ribs into frangible links.

15. A chain of reclosable plastic bags comprising in combination:

a series of bags of plastic material having front and rear walls and upper and lower ends, with reclosable pressure interlocking rib and groove elements on confronting faces at said lower end which will form the bag top when the bag is disassociated from the chain;

seams forming side edges of the bags with the bag walls being unattached along said upper end so that each bag may be filled by inserting contents between said edges;

a stiffening rib projecting outwardly on each of said walls and extending in parallel relation to said unattached edges;

each of said ribs being of such a size and shape that they will cooperate to act as guides and supporting means during a bag filling operation;

said ribs being aligned along the bag chain but being discontinuous from one another at said seams;

each of said ribs providing a downwardly facing shoulder along its lower side for supporting and guiding the associated bag along upwardly facing shoulder means associated with means for filling the bags;

and spot seals connecting the side seams of adjacent bags in line with said ribs and also in line with said rib and groove elements so that the bags although otherwise separated are connected together adjacent to both said upper and lower ends, said spot seals formed by a heat seal sealing said ribs into frangible links.

* * * * *